US007760171B2

(12) United States Patent
Kwon

(10) Patent No.: US 7,760,171 B2
(45) Date of Patent: Jul. 20, 2010

(54) ORGANIC LIGHT EMITTING DISPLAY USING A CURRENT SINK DRIVER TO SET THE VOLTAGE OF THE DRIVING TRANSISTOR

(75) Inventor: Oh Kyong Kwon, Seoul (KR)

(73) Assignees: Samsung Mobile Display Co., Ltd., Yongin-si (KR); IUCF-HYU (Industry—University Cooperation Foundation Hanyang University), Seoul (KR)

( * ) Notice: Subject to any disclaimer, the term of this patent is extended or adjusted under 35 U.S.C. 154(b) by 711 days.

(21) Appl. No.: 11/678,028

(22) Filed: Feb. 22, 2007

(65) Prior Publication Data

US 2007/0200814 A1 Aug. 30, 2007

(30) Foreign Application Priority Data

Feb. 28, 2006 (KR) ..... 10-2006-0019353

(51) Int. Cl.
*G09G 3/32* (2006.01)

(52) U.S. Cl. ..... 345/82

(58) Field of Classification Search ..... 345/76, 345/82

See application file for complete search history.

(56) References Cited

U.S. PATENT DOCUMENTS

2004/0100427 A1* 5/2004 Miyazawa ..... 345/76
2004/0196239 A1* 10/2004 Kwon ..... 345/92
2005/0007357 A1* 1/2005 Yamashita et al. ..... 345/204
2005/0151705 A1* 7/2005 Fish ..... 345/76
2005/0174307 A1* 8/2005 Nishitoba et al. ..... 345/76
2005/0259052 A1* 11/2005 Shin ..... 345/77

FOREIGN PATENT DOCUMENTS

KR 2002-0025774 4/2002
KR 10-2005-0035550 4/2005

OTHER PUBLICATIONS

Korean Patent Abstracts, Publication No. 1020020025774; Publication Date: Apr. 4, 2002; in the name of Kimura.
Office action dated Dec. 15, 2006 for corresponding patent application No. KR 10-2006-0019353.
Korean Patent Abstracts, Publication No. 1020050035550 A, Published on Apr. 19, 2005, in the name of Chien et al.

* cited by examiner

*Primary Examiner*—Richard Hjerpe
*Assistant Examiner*—Andrew Schnirel
(74) *Attorney, Agent, or Firm*—Christie, Parker & Hale, LLP

(57) ABSTRACT

A pixel including an organic light emitting diode for use in an organic light emitting display device and a method for driving the display device. First and second transistors are coupled with a current supply line and are turned-on by a scan signal supplied to a scan line to charge a first capacitor to a voltage corresponding to a current through the current supply line. A third transistor supplies a current corresponding to the voltage charged in the first capacitor to the diode. A fourth transistor coupled to a data line is turned-on by a select signal supplied to an address line to charge a second capacitor to a voltage corresponding to a current flowing in the data line. A fifth transistor is coupled between the third transistor and the diode, and is turned-on/off according to the voltage charged in the second capacitor.

25 Claims, 11 Drawing Sheets

ORGANIC LIGHT EMITTING DISPLAY USING A CURRENT SINK DRIVER TO SET THE VOLTAGE OF THE DRIVING TRANSISTOR

CROSS-REFERENCE TO RELATED APPLICATIONS

This application claims priority to and the benefit of Korean Patent Application No. 10-2006-0019353, filed on Feb. 28, 2006, in the Korean Intellectual Property Office, the entire content of which is incorporated herein by reference.

BACKGROUND

1. Field of the Invention

The present invention relates to a pixel, an organic light emitting display device, and a method for driving an organic light emitting display device using the pixel, and more particularly to a method for driving an organic light emitting display device in a digital pattern, an organic light emitting display device being driven in the digital pattern, and a pixel included in the organic light emitting display device that is being driven in the digital pattern.

2. Discussion of Related Art

Organic light emitting display devices are a type of flat panel display device that make use of organic light emitting diodes that emit light by re-combination of electrons and holes. The organic light emitting display device has advantages of high response speed and small power consumption.

FIG. 1 is a block diagram of a conventional organic light emitting display device. The conventional organic light emitting display device includes a display region 30, a scan driver 10, a data driver 20, and a timing controller 50. The display region 30 includes a plurality of pixels 40 formed at a crossing area of scan lines S1 to Sn and data lines D1 to Dm. The scan driver 10 drives the scan lines S1 to Sn. The data driver 20 drives the data lines D1 to Dm. The timing controller 50 controls the scan driver 10 and the data driver 20.

The scan driver 10 generates a scan signal in response to a scan drive control signal SCS from the timing controller 50, and sequentially provides the generated scan signal to the scan lines S1 to Sn. The scan driver 10 also generates an emission control signal in response to the scan drive control signal SCS from the timing controller 50, and sequentially provides the generated emission control signal to the emission control lines E1 to En.

The data driver 20 receives the data drive control signal DCS from the timing controller 50. Upon the receipt of the data drive control signal DCS, the data driver 20 generates data signals, and provides the generated data signals to the data lines D1 to Dm. The data driver 20 provides the generated data signals to the data lines D1 to Dm every 1 horizontal period.

The timing controller 50 generates the data drive control signal DCS and the scan drive control signal SCS according to externally supplied synchronous signals. The data drive control signal DCS is provided to the data driver 20, and the scan drive control signal SCS is provided to the scan driver 10. The timing controller 50 also provides externally supplied data Data to the data driver 20.

The display region 30 receives power from a first power supply ELVDD and a second power supply ELVSS that are located outside the organic light emitting display device, and provides them to the pixels 40. Upon receiving power from the first power supply ELVDD and the second power supply ELVSS, the pixels 40 control the amount of a current into the second power supply ELVSS from the first power supply ELVDD. The amount of the current is controlled to correspond to the data signal. The current is passed through a light emitting element in the pixel, thus generating light corresponding to the data signal. Furthermore, emission time of the pixels 40 is controlled by the emission control signal.

In the aforementioned conventional organic light emitting display device, the data signal generated by the data driver 20 is represented by a voltage corresponding to data provided to the data driver 20. As a result, the pixel 40 is charged with the voltage corresponding to the supplied data signal to display an image. In other words, the conventional organic light emitting display device controls the voltage value of the data signal to be supplied to the pixel 40, thereby controlling a luminance of light emitted in the pixel 40. However, when the data signal is provided as a voltage, a desired image cannot be displayed in the pixel 40.

Each of the pixels 40 includes a plurality of transistors. The threshold voltage and the electron mobility of transistors included in the pixels 40 may deviate from a desired value due to variations introduced during the fabrication process. Therefore, when a data signal having a certain voltage is provided to the pixels 40, due to the deviation of the transistors included in the different pixels 40 from the ideal characteristics, an image of a desired luminance cannot be displayed.

SUMMARY OF THE INVENTION

Accordingly, it is an aspect of the present invention to provide a pixel and an organic light emitting display device including the pixel which are driven in a digital pattern in order to display an image of a desired luminance, and a method for driving the organic light emitting display device, using the pixel, that employs the digital pattern.

One embodiment of the present invention provides a pixel including an organic light emitting diode, first and second transistors coupled with a current supply line, and being turned-on by a scan signal supplied to a scan line, a first capacitor being charged with a voltage corresponding to an electric current flowing into the current supply line when the first and second transistors are turned-on, a third transistor for supplying an electric current corresponding to the voltage charged in the first capacitor to the organic light emitting diode, a fourth transistor coupled with a data line, and being turned-on by a select signal supplied to an address line, a second capacitor being charged with a voltage corresponding to an electric current flowing into the data line when the fourth transistor is turned-on, and a fifth transistor coupled between the third transistor and the organic light emitting diode, and being turned-on/off according to the voltage charged in the second capacitor.

In one embodiment, an electric current to be supplied to the organic light emitting diode flows into the current supply line when the pixel emits light with maximum luminance. In one embodiment, the selection signal is supplied at predetermined intervals so that an image is displayed using a supply time of an electric current supplied to the organic light emitting diode.

Another aspect of the present invention provides an organic light emitting display device including a display region including a plurality of pixels coupled with scan lines, data lines, current supply lines, and address lines, a scan driver for supplying a scan signal to the scan lines to sequentially the pixels in horizontal lines, a current sink coupled with the current supply lines for sinking a current from pixels selected by the scan signal, an address driver for providing a select signal to the address lines at predetermined intervals, and a data driver for supplying a data signal to synchronize with the select signal in order to control emissions and non-emissions of the pixels.

In one embodiment, the current sink receives an electric current to be supplied to the organic light emitting diode from a pixel selected by the scan signal when the pixel emits light with maximum luminance. In one embodiment, the pixel is charged with a voltage corresponding to an electric current flowing into the current supply line, and the pixel receives the data signal, and emits or does not emit light according to the data signal when the select signal is supplied to the pixel. In one embodiment, the current sink includes sample/hold sections coupled with the current supply lines for sinking the current, a first switch for controlling coupling between the sample/hold sections and the current supply lines, a second switch for controlling a coupling to supply a reference current to at least one of the sample/hold sections, and a controller for controlling the sample/hold sections, the first switch, and the second switch.

According to another aspect of the present invention, there is provided a method for driving an organic light emitting display device including (i) selecting pixels by sequentially supplying a scan signal, (ii) sinking a current from the selected pixels to charge the pixel with a voltage corresponding to the current, and (iii) controlling emission or non-emission of the pixels charged with the voltage by supplying a data signal to the pixels at predetermined intervals.

In one embodiment, the current is set to be the same current as that to be supplied to an organic light emitting diode when the pixels emit light with maximum luminance in step (ii).

DETAILED DESCRIPTION

In the following description the term coupled is used to indicate a direct or indirect connection between two elements or an electrical connection between two elements of a circuit.

Figure 1:
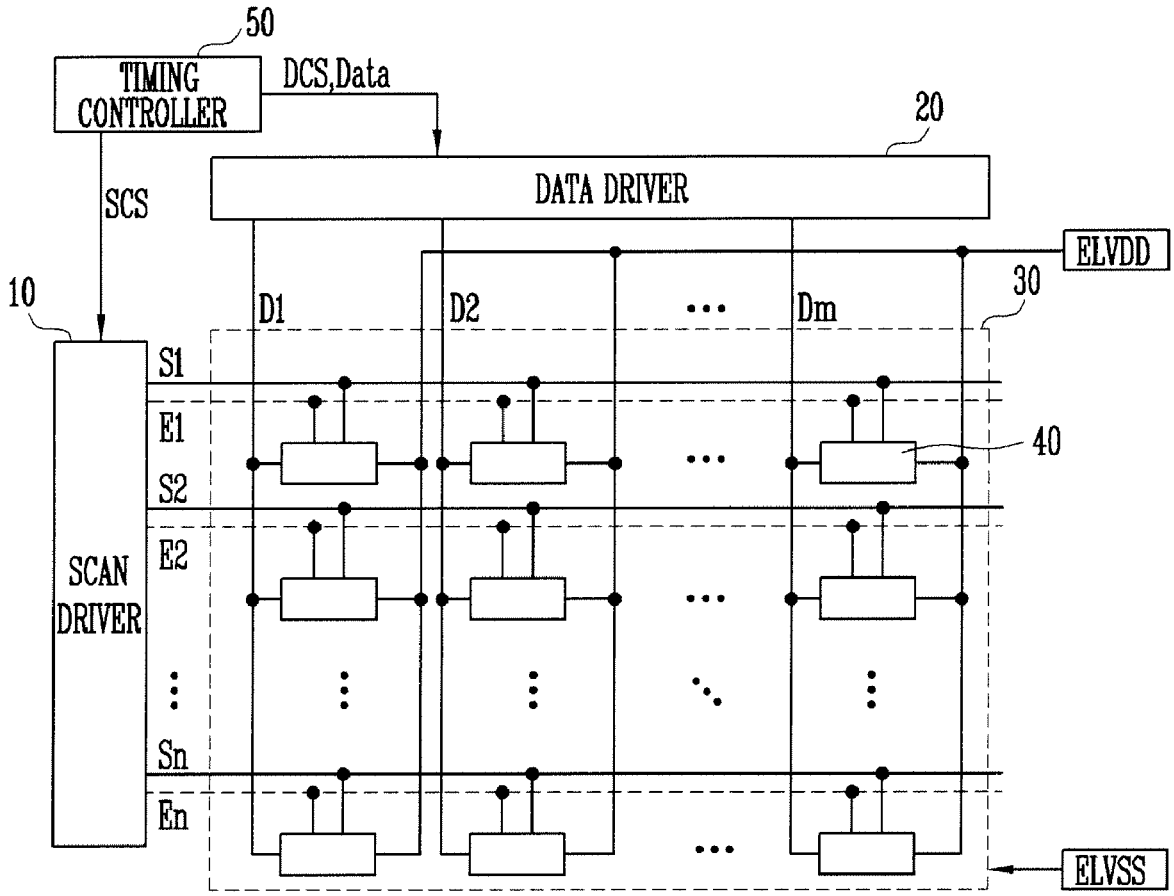
FIG. 1 (PRIOR ART)
FIG. 1 shows a conventional organic light emitting display device.
Figure 2A:
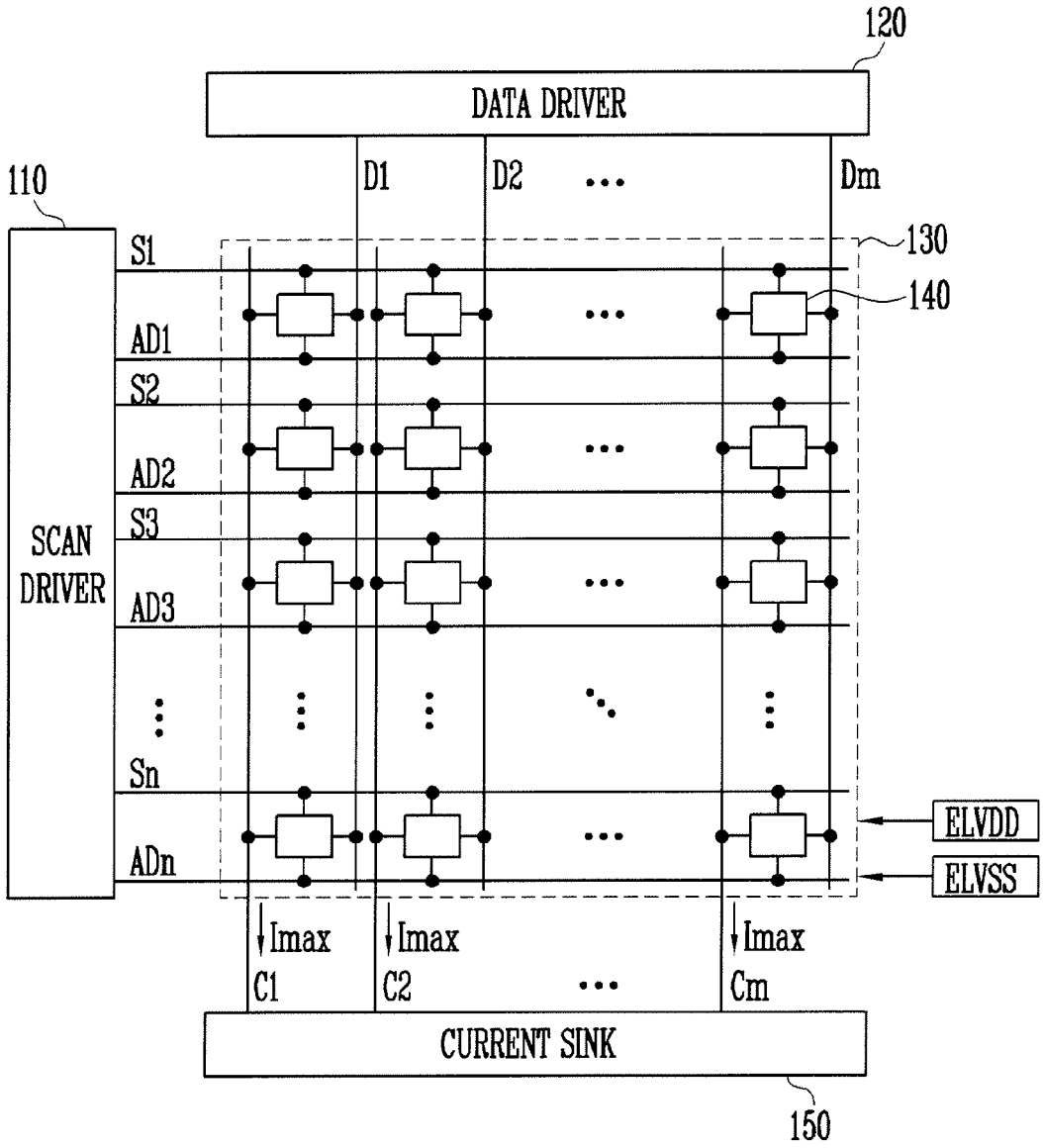
FIG. 2A shows an organic light emitting display device according to a first embodiment of the present invention.
Figure 3:
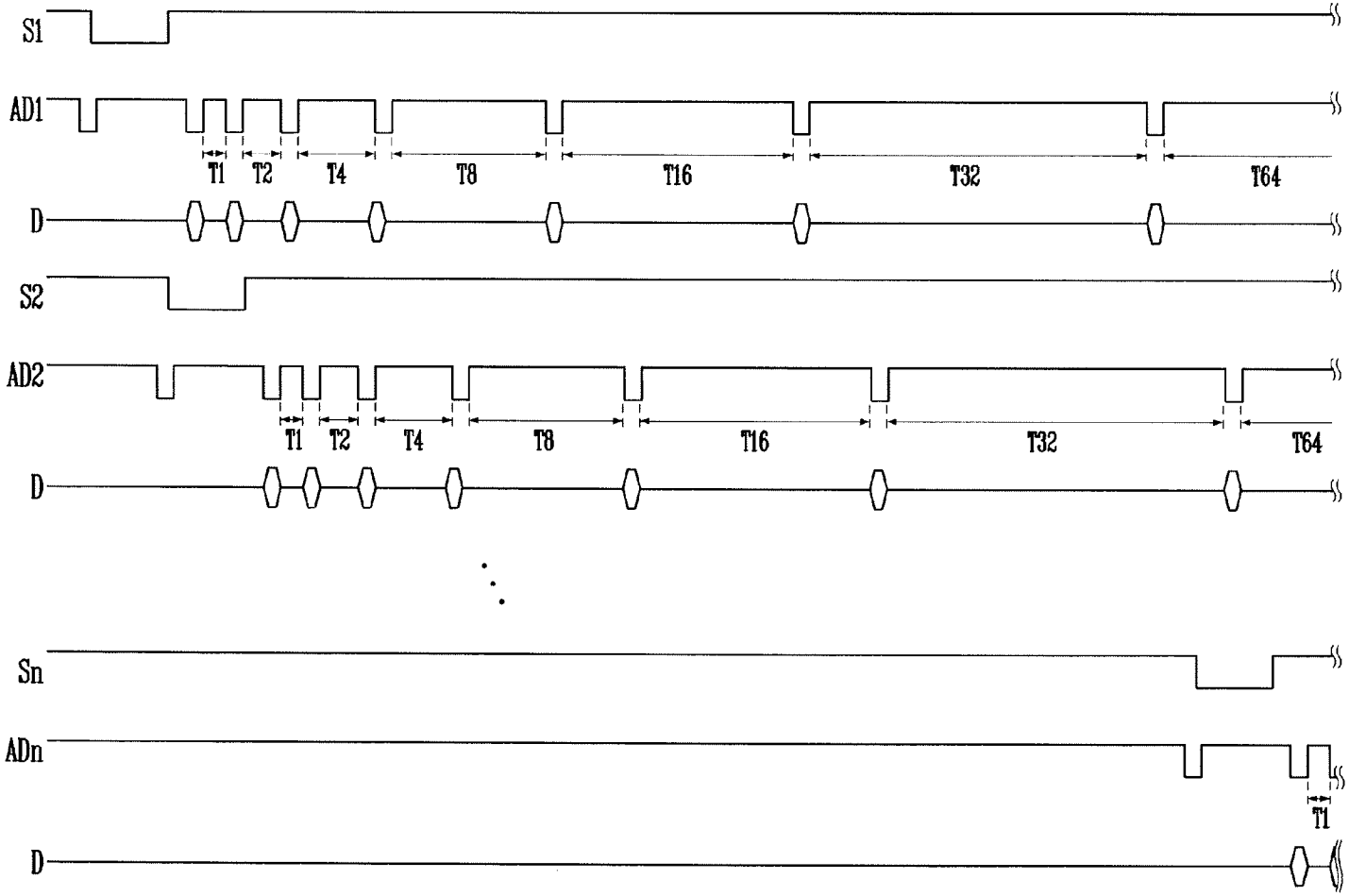
FIG. 3 shows waveforms of signals supplied from drivers shown in FIG. 2A and FIG. 2B.

FIG. 2A shows a block diagram of an organic light emitting display device according to a first embodiment of the present invention. FIG. 3 shows waveforms of signals supplied from drivers shown in FIG. 2A.

As shown in FIG. 2A, the organic light emitting display device according to a first embodiment of the present invention includes a display region 130, a scan driver 110, a data driver 120, and a current sink 150. The display region 130 includes a plurality of pixels 140 formed at crossing areas of scan lines S1 to Sn, address lines AD1 to ADn, data lines D1 to Dm, and current supply lines C1 to Cm. The scan driver 110 drives the scan lines S1 to Sn and the address lines AD1 to ADn. The data driver 120 drives the data lines D1 to Dm. The current sink 150 drives the current supply lines C1 to Cm.

As shown in FIG. 3, the scan driver 110 sequentially provides a scan signal to the scan lines S1 to Sn to sequentially select the pixels 140 located along consecutive scan lines. The scan driver 110 also provides a select signal to the address lines AD1 to ADn. The scan driver 110 provides the select signal to the address line coupled with a pixel 140 selected by a scan signal at predetermined time intervals shown as T1, T2, T4, T8, etc. The predetermined time intervals may be, for example, intervals of $2^0$, $2^1$, $2^2$, $2^3$, . . . units of time such as 1, 2, 4, 8 . . . fractions of seconds.

In more detail, after the scan signal is supplied to a first scan line S1, the scan driver 110 provides the select signals to a first address line AD1. In one exemplary embodiment, the select signals are supplied at intervals of $2^0$, $2^1$, $2^2$, $2^3$, . . . units of time. When the select signal is supplied, a data signal is also provided to the pixels 140. In the intervals between the select signals, when the select signal is not being supplied, the pixels 140 emit or do not emit light according to the data signal being provided to the pixel. Emission times of the pixels 140 overlap one another to express a gradation. The select signals supplied to the address lines AD1 to ADn do not overlap so that desired data signals provided to the data lines D1 to Dm may be provided to the pixels.

The data driver 120 provides a data signal to the data lines D1 to Dm. The data signal may be set to have a voltage corresponding to a digital signal, namely, a logic value of "1" or "0." Further, as shown in FIG. 3, the data signal is supplied in synchronization with the select signal. The data lines D1 to Dm are shown as D in FIG. 3.

The current sink 150 sinks a current from pixels selected by a scan signal via the current supply lines C1 to Cm. In practice, the current sink 150 receives an electric current Imax that flows through an organic light emitting diode included in the pixels selected by the scan signal when the pixels 140 emit light at their maximum luminance.

The display region 130 receives power from a first power supply ELVDD and a second power supply ELVSS that are located outside the organic light emitting display device, and provides the received power to the pixels 40.

When the scan signal is supplied to the pixels 140, the pixels 140 are charged with a voltage corresponding to the current Imax, and emit or do not emit light according to a data signal supplied in synchronization with the select signal. The pixels 140 emit light at predetermined intervals according to the data signal. For example, the pixels 140 emit or do not emit light at intervals of T1=$2^0$, T2=$2^1$, T4=$2^2$, T8=$2^3$, . . . to express an image of a predetermined gradation.

Figure 2B:
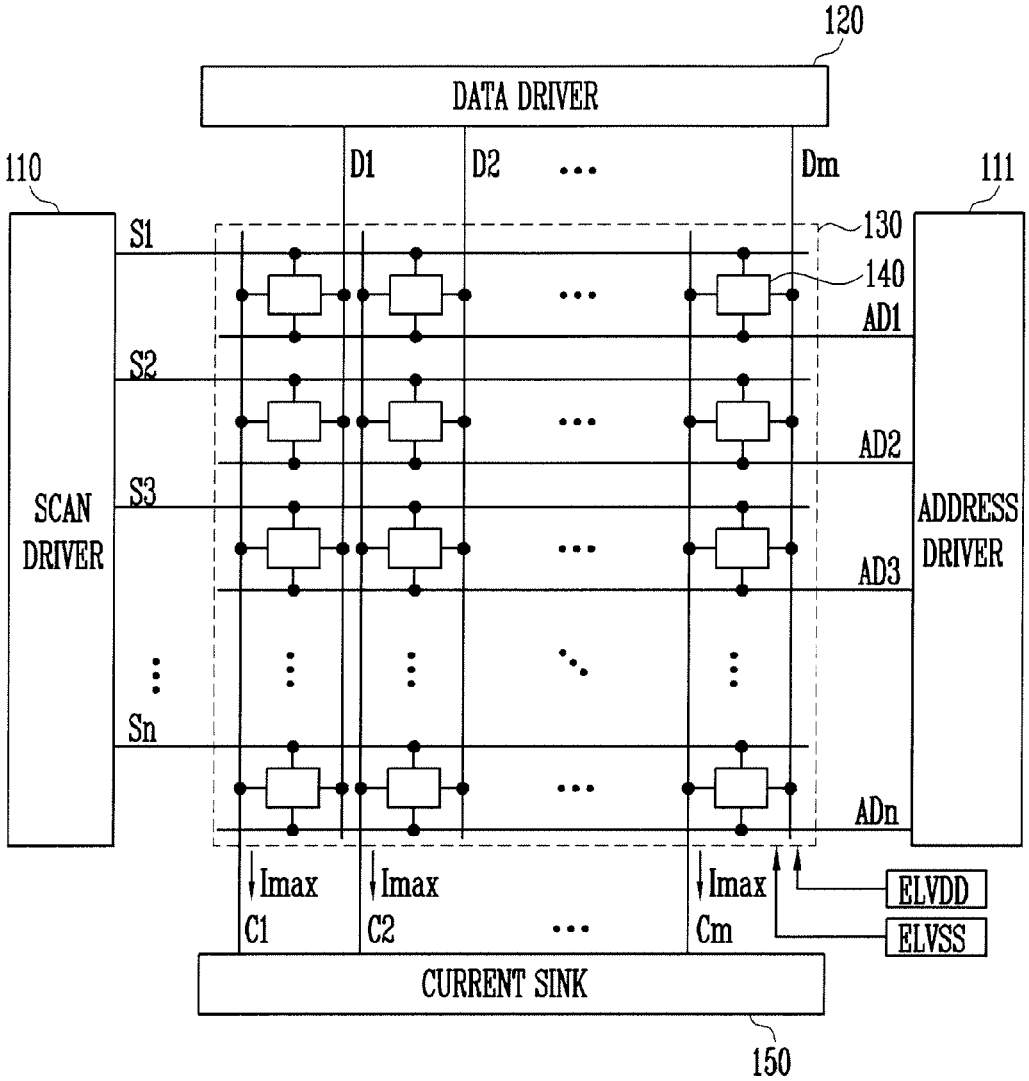
FIG. 2B shows an organic light emitting display device according to a second embodiment of the present invention.

FIG. 2A shows one scan driver 110 for driving both the scan lines S1. Sn and the address lines AD1 to And. However, as shown in FIG. 2B, an address driver 111 for driving the address lines AD1 to ADn can be installed in addition to a scan driver 110' for driving the scan lines. In other words, the address driver 111 can be included in the scan driver 110 as shown in FIG. 2A, or formed separately as shown in FIG. 2B.

Figure 4:
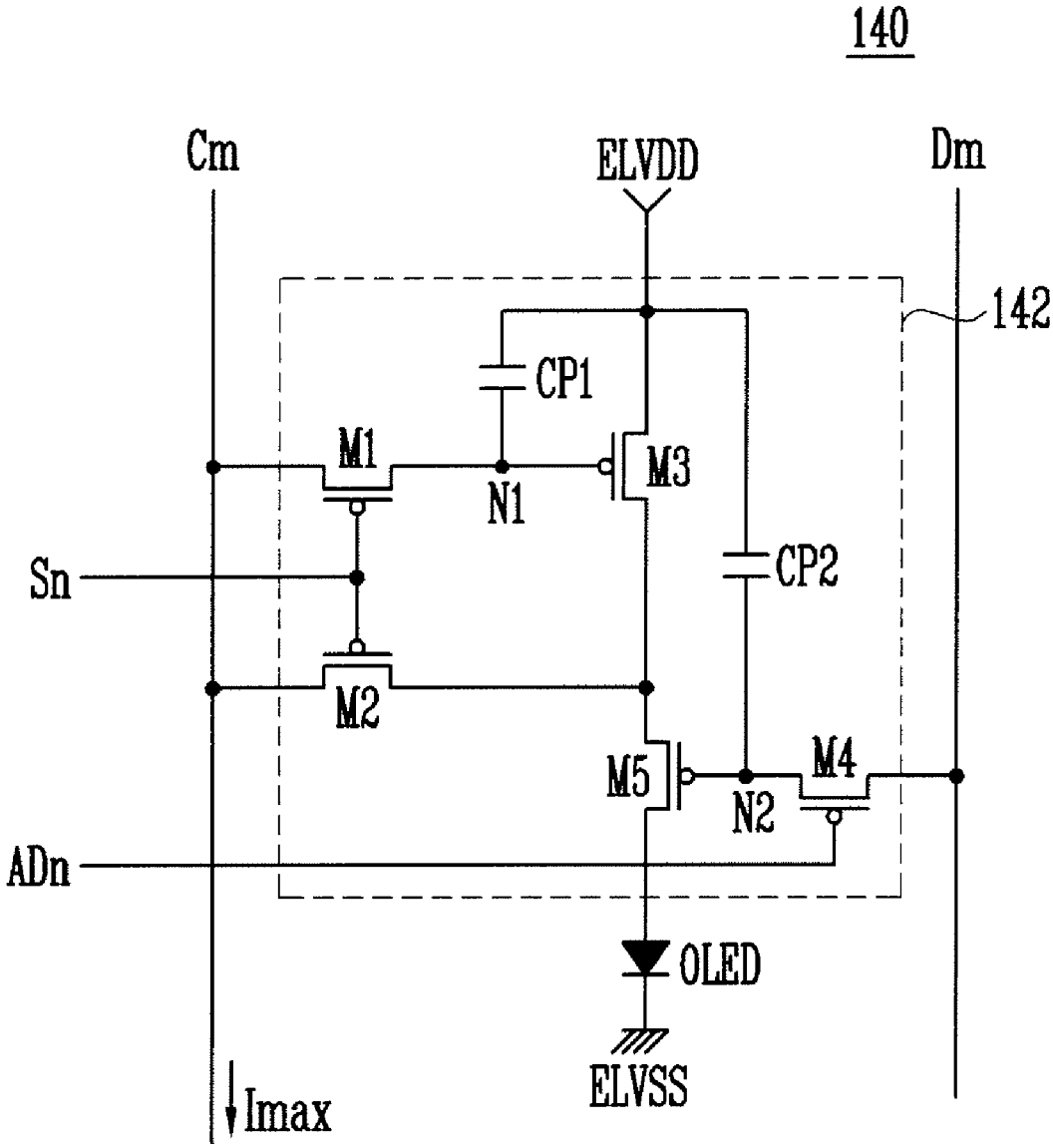
FIG. 4 shows a pixel according to an embodiment of the present invention.

FIG. 4 shows an exemplary circuit for the pixel shown in FIG. 2A or FIG. 2B. For convenience of description, FIG. 4 shows a pixel coupled with an n-th scan line Sn, an n-th address line ADn, an m-th current supply line Cm, and an m-th data line Dm.

The pixel according to an embodiment of the present invention includes an organic light emitting diode OLED and a pixel circuit 142. The pixel circuit 142 supplies an electric current to the organic light emitting diode OLED.

The organic light emitting diode OLED generates light corresponding to the electric current supplied from the pixel circuit 142. The generated light may be red, green, or blue depending on the type of the organic light emitting diode used in each pixel.

The pixel circuit 142 controls the supply time of an electric current flowing into the second power supply ELVSS from the first power supply ELVDD through the organic light emitting diode OLED corresponding to the scan signal, the data signal, and the select signal. So as to do this, the pixel circuit 142 includes first to fifth transistors M1 to M5, and first and second capacitors CP1 and CP2.

A first electrode of the first transistor M1 is coupled with the current supply line Cm, and a second electrode thereof is coupled with a first node N1. A gate electrode of the first transistor M1 is coupled with the scan line Sn. When the scan signal is supplied to the first transistor M1, the first transistor M1 is turned-on to electrically connect the current supply line Cm and the first node N1 to each other. Either of the first and second electrodes of the first transistor M1 may be a source electrode or a drain electrode. For example, when the first electrode is set as the source electrode, the second electrode would be the drain electrode.

A first electrode of the second transistor M2 is coupled with the current supply line Cm, and a second electrode thereof is coupled with a second electrode of the third transistor M3. Moreover, a gate electrode of the second transistor M2 is coupled with the scan line Sn. When the scan signal is supplied to the second transistor M2, the second transistor M2 is turned-on to electrically connect the current supply line Cm and the second electrode of the third transistor M3 to each other.

A first electrode of the third transistor M3 is coupled with the first power supply ELVDD, and the second electrode thereof is coupled with a first electrode of the fifth transistor M5. Furthermore, a gate electrode of the third transistor M3 is coupled with the first node N1. The third transistor M3 provides an electric current corresponding to the voltage charged in the first capacitor CP1 to the first electrode of the fifth transistor M5.

A first electrode of the fourth transistor M4 is coupled with the data line Dm, and a second electrode thereof is coupled with a second node N2. Moreover, a gate electrode of the fourth transistor M4 is coupled with the address line ADn. When the select signal is supplied to the fourth transistor M4, the fourth transistor M4 is turned-on to provide the data signal from the data line Dm to the second node N2.

The second electrode of the fifth transistor M5 is coupled with the organic light emitting diode OLED. Further, a gate electrode of the fifth transistor M5 is coupled with the second node N2. The fifth transistor M5 is turned-on/off according to a voltage charged in the second capacitor CP2.

During a supply period of the scan signal, the first capacitor CP1 is charged with a voltage corresponding to an electric current Imax flowing into the current supply line Cm.

When the fourth transistor M4 is turned-on, the second capacitor CP2 is charged with a voltage corresponding to a data signal supplied to the data line Dm. The fifth transistor M5 is turned-on/off according to the voltage charged in the second capacitor CP2.

While, for convenience of description, FIG. 4 shows transistors M1 to M5 as PMOS transistors, the present invention is not limited to transistors of one conductivity type.

Figure 5:
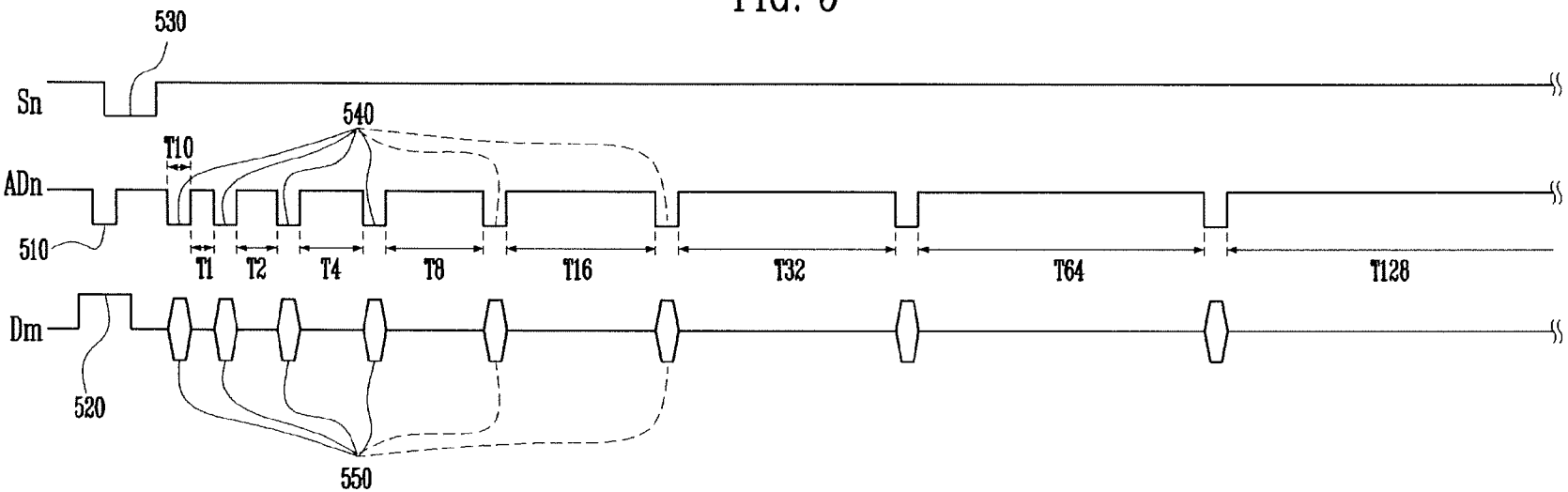
FIG. 5 is a waveform diagram showing a signal sequence for a method for driving the pixel shown in FIG. 4.

FIG. 5 is a waveform diagram showing a signal sequence for a method for driving the pixel shown in FIG. 4.

Operation of the pixel will be described referring to FIG. 4 and FIG. 5. At first, an initialization signal 510 is supplied to the address line ADn. A first polarity signal 520 is supplied to the data line Dm in synchronization with the initialization signal such that the two signals 510 and 520 at least partially overlap. When the initialization signal 510 is provided to the address line ADn, the fourth transistor M4 is turned-on. When the fourth transistor M4 is turned-on, the first polarity signal 520 is supplied to the second node N2. The first polarity signal may be a high logic signal to initialize a charged voltage of the second capacitor CP2. For example, the first polarity signal may be set to the same voltage as the voltage of the first power supply ELVDD. Alternatively, the second capacitor CP2 may be initialized without supplying the initialization signal to the address line ADn.

When the initialization signal 510 is supplied to the address line ADn, the scan signal 530 is supplied to partially overlap with the initialization signal 510. When the scan signal is supplied to the scan line Sn, the first transistor M1 and the second transistor M2 are turned-on. When the first transistor M1 is turned-on, the first node N1 and the current supply line Cm are electrically connected with each other. When the second transistor M2 is turned-on, the second electrode of the third transistor M3 is electrically connected with the current supply line Cm.

As a result, a current path is formed between the first power supply ELVDD and the current supply line Cm through the third transistor M3 and the second transistor M2. Accordingly, a current Imax from the first power supply ELVDD through the third transistor M3, the second transistor M2 and the current supply line Cm is sunk to the current sink 150. At the same time, the first capacitor CP1 is charged with a voltage corresponding to the current Imax flowing through the third transistor M3.

The voltage charged in the first capacitor CP1 is determined by the current Imax flowing through the third transistor M3. The voltage charged in the first capacitor CP1 establishes a source to gate voltage between the source and the gate of the third transistor M3 that is independent of the threshold voltage of the third transistor M3. As a result, any non-uniformity between the threshold voltages and electron mobilities of the transistors included in the various pixels will not impact the operation of the transistors that are located where M3 is located in the pixel 140.

After the first capacitor CP1 is charged with the voltage corresponding to the current Imax, supply of the scan signal 530 stops and the first transistor M1 and the second transistor M2 are turned-off. In this case, the third transistor M3 is turned-off in response to the change in the voltage charged in the first capacitor CP1. Next, a select signal 540 is supplied to the address line ADn to turn-on the fourth transistor M4. When the fourth transistor M4 is turned-on, the data signal 550 supplied to the address line ADn is provided to the second node N2 in synchronization with the select signal. The data signal may be set to a first polarity (high logic) or a second polarity (low logic).

When the data signal being applied is set to the first polarity, i.e. is high, the second capacitor CP2 is not charged with a voltage. Accordingly, after the supply of the select signal has stopped, the fifth transistor M5 is turned-off during the first period T1, with the result that the organic light emitting diode OLED does not emit light. In contrast, when the data signal being applied to the data line Dm has the second polarity or a low logic value, the second capacitor CP2 is charged with a voltage. In this case, after the supply of the select signal has stopped, the fifth transistor M5 is turned-on during the first period T1, with the result that the organic light emitting diode OLED emits light.

After the first period T1, another one of the select signals 540 is supplied to the address line ADn to turn-on the fourth transistor M4. In the exemplary embodiment shown, all select signals supplied to the address line ADn have the same width. When the fourth transistor M4 is turned-on, the first polarity data signal or the second polarity data signal supplied to the data line Dm, is provided to the second node N2. Further, during the second period T2, the fifth transistor M5 is turned-on/off according to the polarity of the data signal supplied to the second node N2 before T2.

Accordingly, emission time intervals after the supply of the select signal are shown as T1, T2, T4, T8, etc. that may be respectively equal to $2^0$, $2^1$, $2^2$, $2^3$, etc. That is, in the embodiments of the present invention, the first capacitor CP1 included in each of the pixels 140 is charged with the same voltage, and the desired gradation is expressed by controlling the emission times of the pixels 140. As mentioned above, when the first capacitor CP1 included in each of the pixels is charged with the same voltage and gradation is expressed using emission times of the pixels, the pixels can display an image of a desired luminance.

Figure 6:
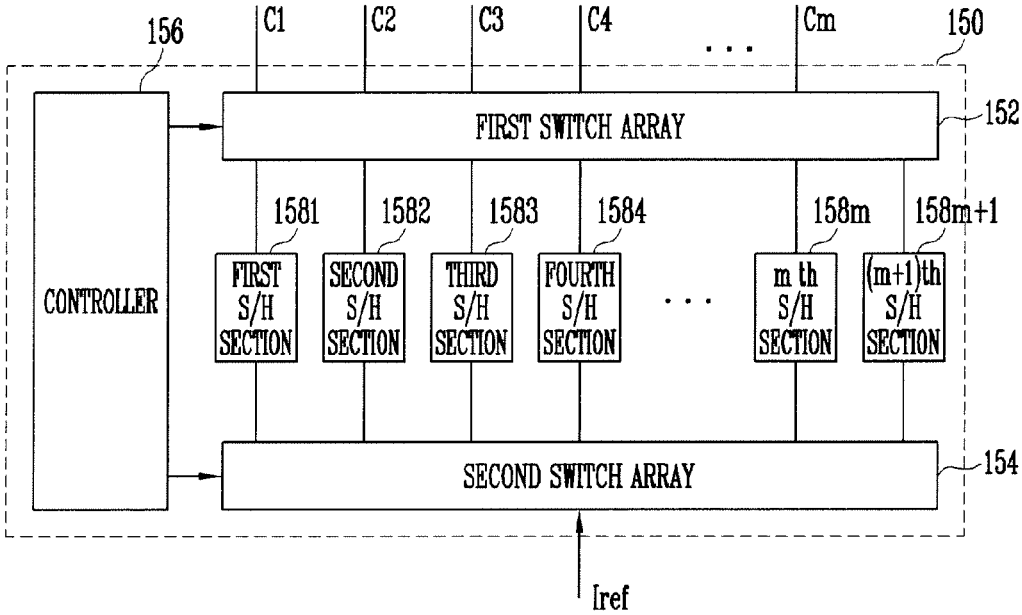
FIG. 6 shows a first example of a current sink according to an embodiment of the present invention.

FIG. 6 shows a first example of a current sink according to an embodiment of the present invention.

The current sink 150 includes a first switch array 152, a plurality of sample/hold sections 1581 to 158*m*+1, a second switch array 154, and a controller 156.

The sample/hold sections 1581 to 158*m*+1 are electrically connected to the current supply lines C1 to Cm to sink the current Imax. The first switch array 152 controls the electrical connection of the sample/hold sections to the current supply lines. In the exemplary embodiment shown, the number of the sample/hold sections 1581 to 158*m*+1 is greater than the number of current supply lines C1 to Cm by one.

The first switch array 152 connects m of the sample/hold sections among (m+1) sample/hold sections 1581 to 158*m*+1 to the current supply line C1 to Cm.

The second switch array 154 supplies the reference current Iref to one sample/hold section among (m+1) sample/hold sections 1581 to 158*m*+1 which is not connected to the current supply lines C1 to Cm. In the embodiment shown, the reference current Iref and the current Imax are associated with the same voltage.

The controller 156 controls operations of the first switch array 152, the sample/hold sections 1581 to 158*m*+1, and the second switch array 154.

Figure 7:
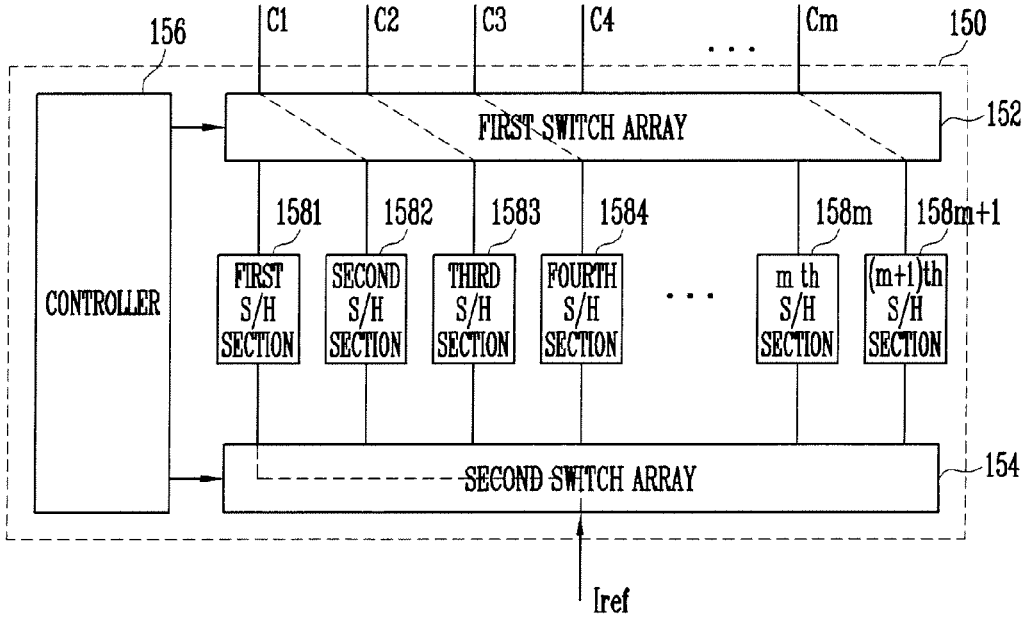
FIG. 7 and FIG. 8 show operation of the current sink shown in FIG. 6.

As shown in FIG. 7, during operation, the controller 156 controls the first switch array 152 to connect m of the sample/hold sections, including sample/hold sections 1582 to 158*m*+1, to the m current supply lines C1 to Cm. Accordingly, the m sample/hold sections 1582 to 158*m*+1, which are selected by the scan signal and are coupled with the m current supply lines C1 to Cm, sink a current Imax from the pixels.

On the other hand, the controller's 156 control of the second switch array 154 causes the second switch array 154 to supply the reference current Iref to the sample/hold section 1581, which is not connected to the current supply lines C1 to Cm. As a result, the sample/hold section 1581 having received the reference current Iref, is charged with a voltage corresponding to the reference current Iref. In other words, when the reference current Iref is supplied to the sample/hold section 1581, the sample/hold section 1581 is charged with a voltage corresponding to the reference current Iref, and is capable of sinking a current Imax from the pixel 140 corresponding to the charged voltage.

Figure 8:
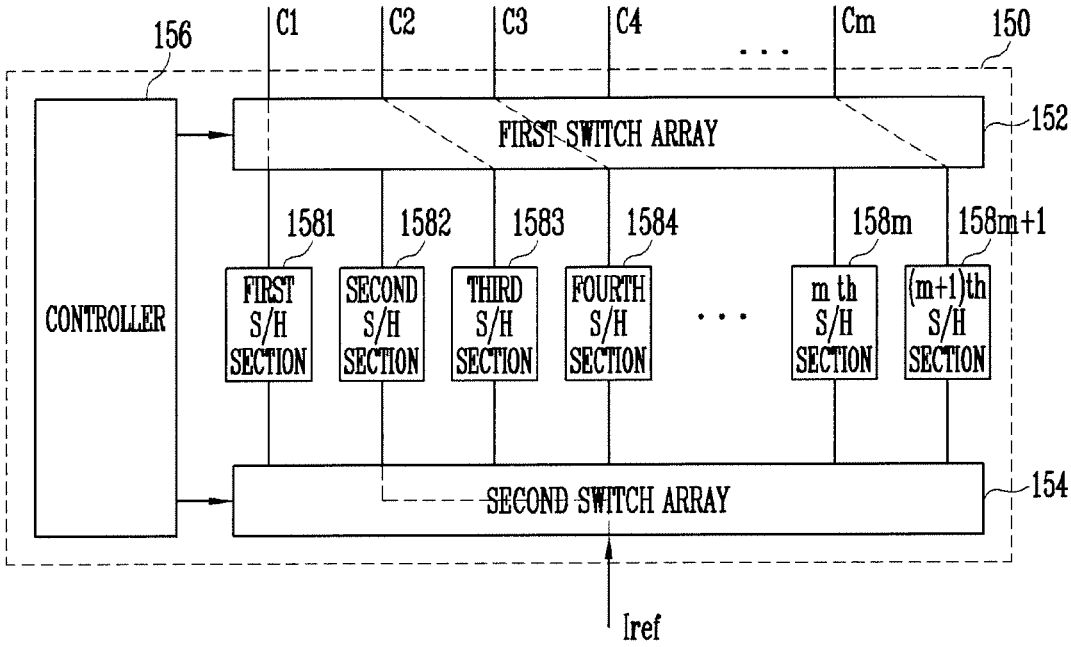

Next, as shown in FIG. 8, the reference current Iref is supplied to another sample/hold section 1582 to again charge the sample/hold section 1582 with a voltage corresponding to the reference current Iref. In one embodiment of the present invention, the reference current Iref is sequentially sent to the sample/hold sections 1581 to 158*m*+1. Accordingly, the sample/hold sections 1581 to 158*m*+1 are sequentially charged with a voltage corresponding to the reference current Iref to stably sink the current from the pixels 140.

Figure 9:
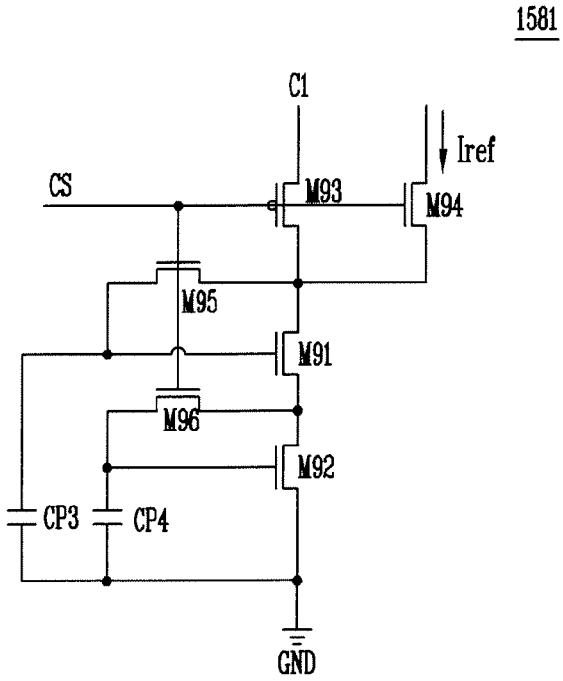
FIG. 9 shows a circuit diagram of an example of a sample/hold section shown in FIG. 6.

FIG. 9 is a circuit diagram of an example of a sample/hold section shown in FIG. 6. For convenience of description, FIG. 9 shows the first sample/hold section 1581.

The sample/hold section 1581 of the present invention includes first to sixth transistors M91 to M96, a third capacitor CP3 and a fourth transistor CP4.

The third transistor M93 is installed between the first transistor M91 and a current supply line C1 (or the first switch array 152). When a control signal CS of the second polarity is supplied to the third transistor M93, the third transistor M93 is turned-on.

The fourth transistor M94 is installed between the second switch array 154 and the first transistor M91. The fourth transistor M94 has a conductivity type that is different from the third transistor M93. Therefore, when a control signal of a first polarity is supplied to the fourth transistor M94, it is turned-on. For example, the third transistor M93 may be formed by a PMOS type transistor when the fourth transistor M94 is configured by an NMOS type transistor. In the exemplary embodiment shown, the first, second, fourth, fifth, and sixth transistors M91, M92, M94, M95, and M96 are configured by transistors of the same conductivity type that is different from the conductivity type of the third transistor M93. That is, except for M93, they are all NMOS transistors.

The first transistor M91 and the second transistor M92 are serially connected to each other between the third transistor M93 and a ground voltage source GND. In the exemplary circuit shown, a first electrode of the first transistor M91 is coupled with the third transistor M93, and a second electrode thereof is coupled with a first electrode of the second transistor M92. Further, a gate electrode of the first transistor M91 is coupled with the third capacitor CP3.

A second electrode of the second transistor M92 is coupled with a ground voltage source GND. A gate electrode of the second transistor M92 is coupled with a fourth capacitor CP4.

The fifth transistor M95 is coupled between the first electrode and the gate electrode of the first transistor M91. When a control signal CS of a first polarity is supplied to the fifth transistor M95, the fifth transistor M95 is turned-on to diode-connect the first transistor M91.

The sixth transistor M96 is coupled between the first electrode and the gate electrode of the second transistor M92. When a control signal CS of a first polarity is supplied to the sixth transistor M96, the sixth transistor M96 is turned-on to diode-connect the second transistor M92.

The third capacitor CP3 is coupled between a gate electrode of the first transistor M91 and the ground voltage source GND. The third capacitor CP3 is charged with a voltage corresponding to an electric current flowing through the first transistor M91.

The fourth capacitor CP4 is coupled between a gate electrode of the second transistor M92 and the ground voltage source GND. The fourth capacitor CP4 is charged with a voltage corresponding to an electric current flowing through the second transistor M92.

In operation, when the control signal CS of a first polarity is supplied, the fourth transistor M94, the fifth transistor M95, and the sixth transistor M96 are turned-on. When the fifth transistor M95 is turned-on, the first transistor M91 is diode-connected. When the sixth transistor M96 is turned-on, the second transistor M92 is diode-connected.

When the fourth transistor M94 is turned-on, the reference current Iref is supplied to the ground voltage source GND through the fourth transistor M94, the first transistor M91, and the second transistor M92. As a result, the third capacitor CP3 is charged with a voltage corresponding to the reference current Iref supplied through the first transistor M91. Moreover, the fourth capacitor CP4 is charged with a voltage corresponding to the reference current Iref, which is supplied through the second transistor M92.

Thereafter, a control signal CS of a second polarity is supplied to the third transistor M93 to turn this transistor on. When the third transistor M93 is turned-on, the first transistor M91 sinks a current Imax from the current supply line C1 corresponding to the voltage charged in the third capacitor CP3. When the third transistor M93 is turned-on, the second transistor M92 sinks a current Imax from the current supply line C1 corresponding to the voltage charged in the fourth capacitor CP4.

An organic light emitting display device includes a red pixel, a green pixel, and a blue pixel. The red pixel includes a red organic light emitting diode, the green pixel includes a green organic light emitting diode, and the blue pixel includes a blue organic light emitting diode. Emission efficiencies of the red, green, and blue organic light emitting diodes are different according to characteristics of materials. Accordingly, when each of the organic light emitting diodes emits light with maximum luminance, the current flowing through the diode would be different according to the color of the light being emitted. A current sink taking into account the different currents is shown in FIG. 10.

Figure 10:
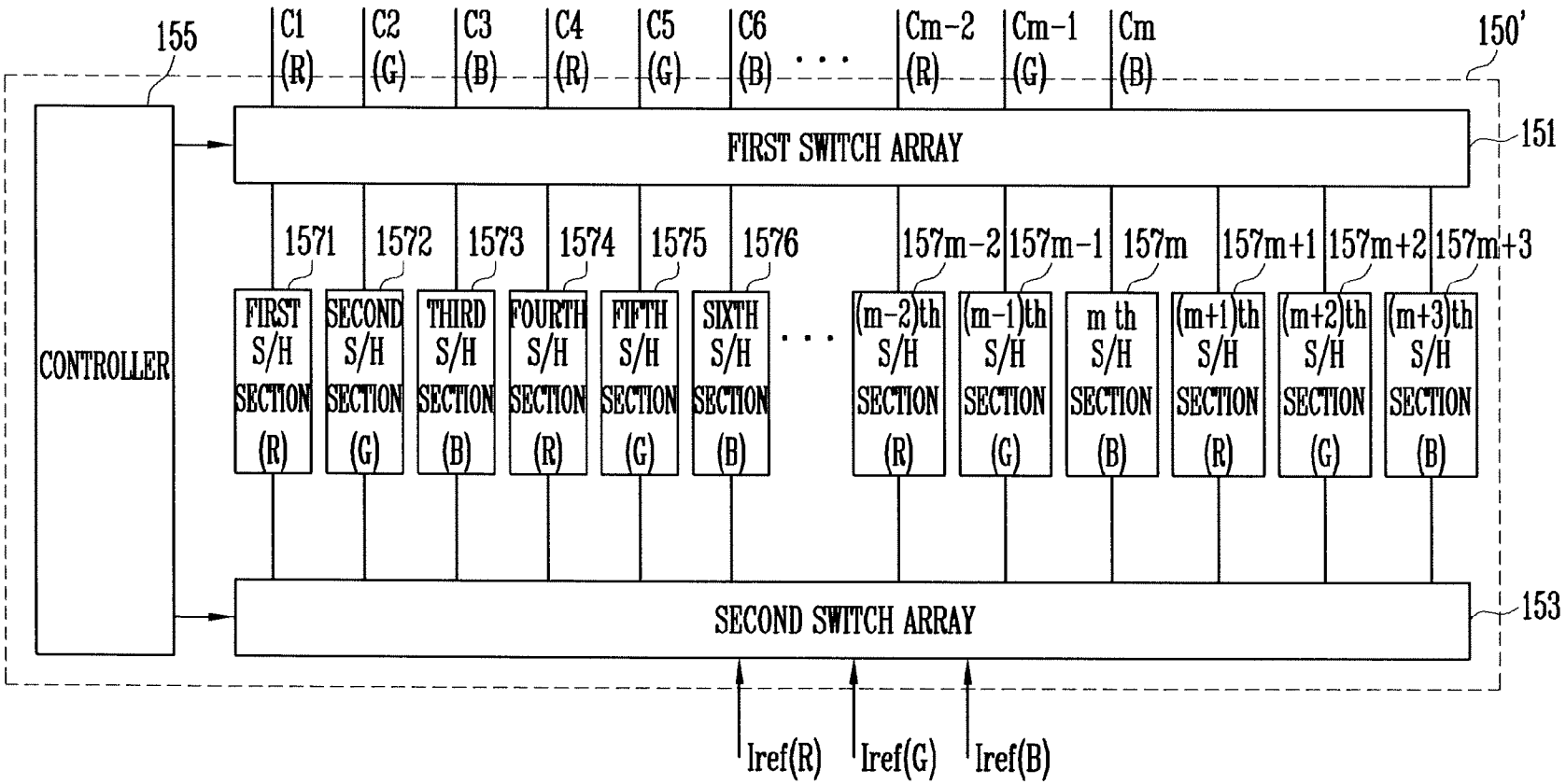
FIG. 10 shows a second example of a current sink according to an embodiment of the present invention.

FIG. 10 shows a second example of a current sink according to an embodiment of the present invention.

The current sink 150' includes a first switch array 151, a plurality of sample/hold sections 1571 to 157*m*+3, a second switch array 153, and a controller 155.

The sample/hold sections 1571 to 157*m*+3 are coupled with the current supply lines C1 to Cm through the first switch array 151 to sink a current Imax. The first switch array 151 controls the electrical connection between the sample/hold sections and the supply lines. In the exemplary embodiment shown, the sample/hold sections 1571 to 157*m*+3 include red sample/hold sections 1571, 1574, . . . , 157*m*−2, and 157*m*+1 coupled with the red pixels, green sample/hold sections 1572, 1575, . . . , 157*m*−1, and 157*m*+2 coupled with the green pixels, and blue sample/hold sections 1573, 1576, . . . , 157*m*, and 157*m*+3 coupled with the blue pixels.

The red sample/hold sections 1571, 1574, . . . , 157*m*−2, and 157*m*+1 are coupled with the red pixels, and sink an electric current to be supplied to a red organic light emitting diode when a red pixel emits light with maximum luminance. The number of the red sample/hold sections 1571, 1574, . . . , 157*m*−2, and 157*m*+1 is set to be greater than the number of the current supply lines C1, C4, . . . , Cm−2 by one.

The green sample/hold sections 1572, 1575, . . . , 157*m*−1, and 157*m*+2 are coupled with the green pixels, and sink an electric current to be supplied to a green organic light emitting diode when a green pixel emits light with maximum luminance. The number of the green sample/hold sections 1572, 1575, . . . , 157*m*−1, and 157*m*+2 is set to be greater than the number of the current supply lines C2, C5, . . . , Cm−1 by one.

The blue sample/hold sections 1573, 1576, . . . , 157*m*, and 157*m*+3 are coupled with the blue pixels, and sink an electric current to be supplied to a blue organic light emitting diode when a blue pixel emits light with maximum luminance. The number of the blue sample/hold sections 1573, 1576, . . . , 157*m*, and 157*m*+3 is set to be greater than the number of the current supply lines C3, C6, . . . , Cm by one. Consequently, the number of the sample/hold section 1571 to 157*m*+3 is greater than the current supply lines C1 to Cm by three.

The first switch array 151 connects m out of the (m+3) sample/hold sections 1571 to 157*m*+3 to the current supply lines C1 to Cm. One red sample/hold section, one green sample/hold section, and one blue sample/hold section remain that are not coupled with the current supply lines C1 to Cm.

The second switch array 153 supplies reference currents Iref(R), Iref(G), and Iref(B) to the three sample/hold sections, which are not coupled with the current supply lines C1 to Cm. A red reference current Iref(R) is supplied to a red sample/hold section, a green reference current Iref(G) is supplied to a green sample/hold section, and a blue reference current Iref (B) is supplied to a blue sample/hold section.

The red reference current Iref(R) is set as an electric current to be sent to a red organic light emitting diode when a red pixel is to emit light with maximum luminance. The green reference current Iref(G) is set as an electric current to be sent to a green organic light emitting diode when a green pixel is to emit light with maximum luminance. The blue reference current Iref(B) is set as an electric current to be sent to a blue organic light emitting diode when a blue pixel is to emit light with maximum luminance.

The controller 155 controls operations of the first switch array 151, the sample/hold sections 1571 to 157*m*+3, and the second switch array 153.

Figure 11:
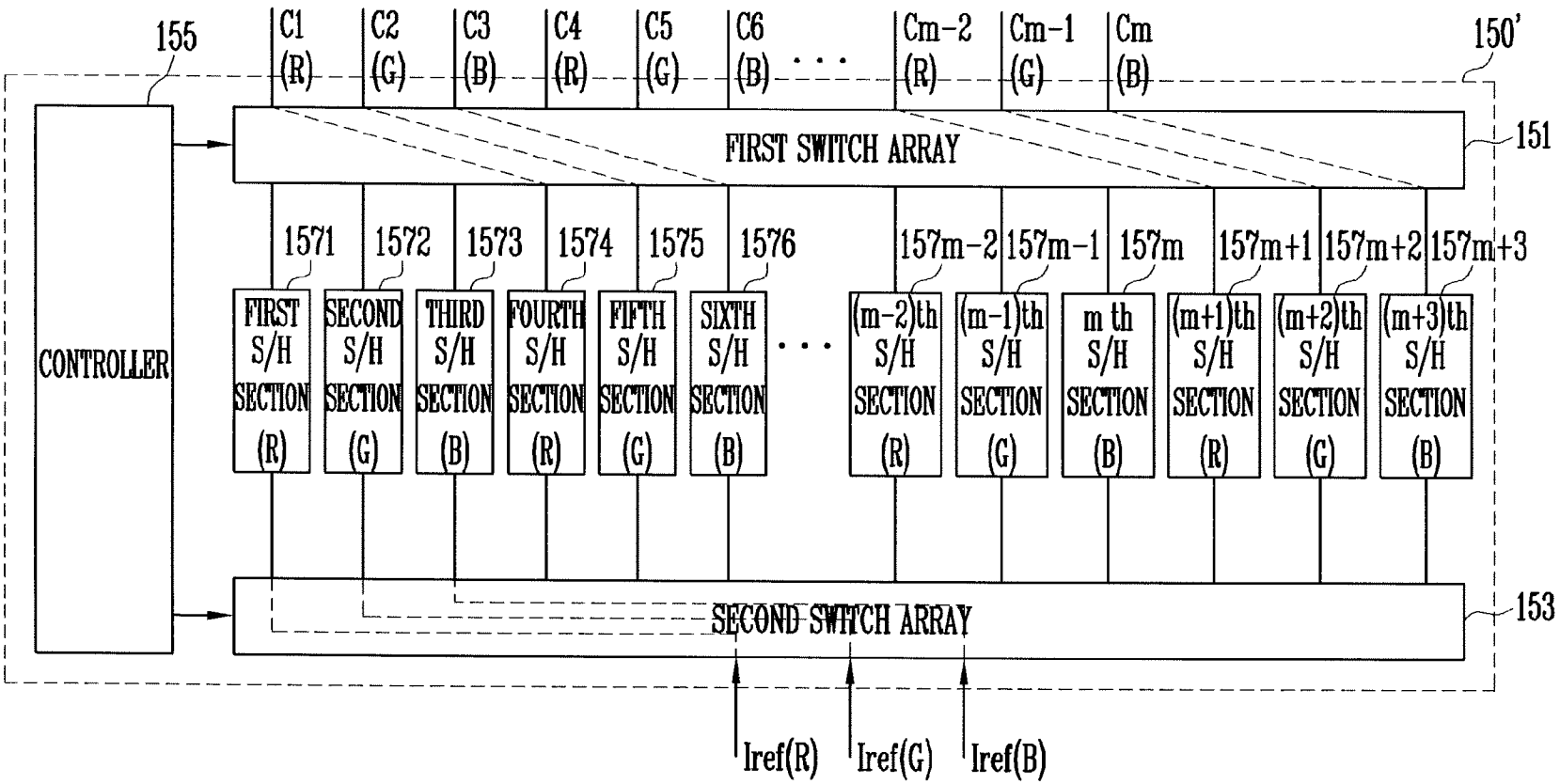
FIG. 11 and FIG. 12 show operation of the current sink shown in FIG. 10.

During operation, as shown in FIG. 11, the controller 155 controls the first switch array 151 to electrically connect the m sample/hold sections 1574 to 157*m*+3 with the m current supply lines C1 to Cm, respectively. The red sample/hold sections 1574, . . . , 157*m*−2, and 157*m*+1 are coupled with the current supply lines C1, C4, . . . , Cm−2, which are coupled with the red pixels. The green sample/hold sections 1575, 157*m*−1, and 157*m*+2 are coupled with the current supply lines C2, C5, . . . , Cm−1, which are coupled with the green pixels. The blue sample/hold sections 1576, 157*m*, and 157*m*+3 are coupled with the current supply lines C3, C6, . . . , Cm, which are coupled with the blue pixels.

The m sample/hold sections 1574 to 157*m*+3 that are electrically connected with the current supply lines C1 to Cm by the first switch array 151 sink a current from pixels.

On the other hand, the controller 155 controls the second switch array 153 to supply reference currents Iref(R), Iref(G), and Iref(B) to sample/hold sections 1571, 1572, and 1573, which are not coupled with the current supply lines C1 to Cm. As a result, in the exemplary embodiment shown, the red reference current Iref(R) is supplied to the red sample/hold section 1571, the green reference current Iref(G) is supplied to the green sample/hold section 1572, and the blue reference current Iref(B) is supplied to the blue sample/hold section 1573.

Figure 12:
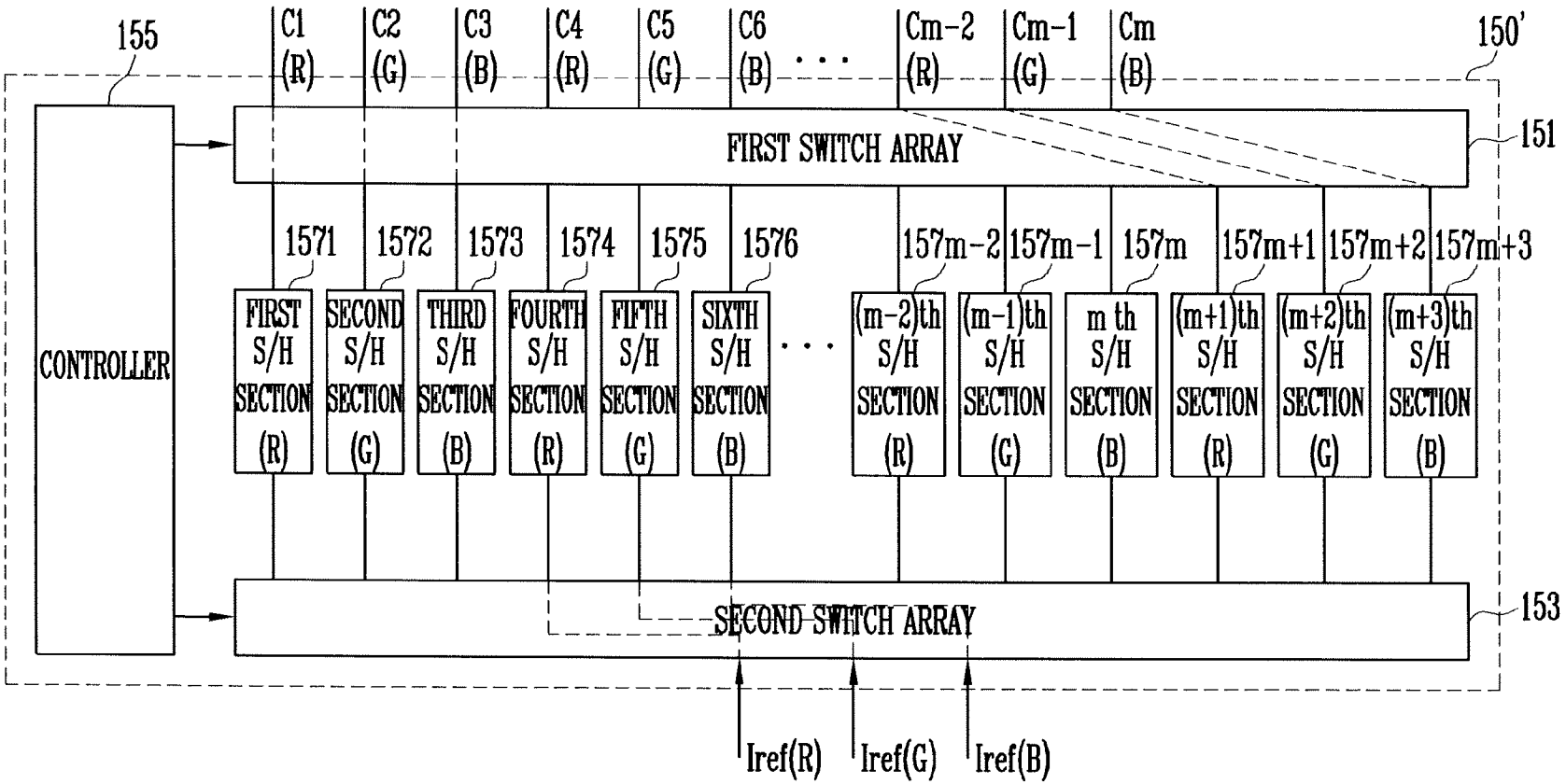

Thereafter, as shown in FIG. 12, the first switch array 151 changes the sample/hold sections coupled with the current supply lines C1 to Cm. The controller 155 controls operations of the first and second switch arrays 151 and 153 so that the reference currents Iref(R), Iref(G), and Iref(B) are now sequentially provided to the sample/hold sections 1571 to 157*m*+3. Accordingly, a voltage stored in each of the red, green, and blue sample/hold sections is recharged and they are stably driven.

As described above, according to a pixel, an organic light emitting display device, and a method for driving an organic light emitting display device using the pixel of the present invention, a pixel is charged with a voltage while sinking a current, and a luminance is expressed while controlling an emission time of the pixel charged with the voltage. Because each pixel is charged with a voltage using a current, the pixel can be charged with a desired voltage irrespective of threshold voltages and electron mobility of transistors included in the pixels. This causes an image of a desired luminance to be displayed.

Although certain exemplary embodiments of the present invention have been shown and described, it would be appreciated by those skilled in the art that changes might be made to these embodiments without departing from the principles and spirit of the invention, the scope of which is defined in the following claims and their equivalents.

What is claimed is:

1. An organic light emitting display device comprising:

a display region including a plurality of pixels coupled with scan lines, data lines, current supply lines, and address lines;

a scan driver for supplying a scan signal to the scan lines to sequentially drive the pixels in horizontal lines, a pixel selected by the scan signal being a selected pixel;

a current sink coupled with the current supply lines for sinking a sinking current from selected pixels;

an address driver for providing a select signal to the address lines at predetermined intervals of time; and a data driver for supplying a data signal to synchronize with the select signal, such that light emissions from the pixels are controlled by synchronization of the data signal and the select signal, wherein the current sink includes:

sample/hold sections coupled with the current supply lines for sinking the sinking current;

a first switch for controlling coupling between the sample/hold sections and the current supply lines;

a second switch for controlling a coupling to supply a reference current to at least one of the sample/hold sections; and a controller for controlling the sample/hold sections, the first switch, and the second switch.

2. The organic light emitting display device of claim 1, wherein the number of the sample/hold sections is at least one more than the number of the current supply lines.

3. The organic light emitting display device of claim 2, wherein the first switch couples all but the at least one more than the number of the current supply lines of the sample/hold sections with the current supply lines.

4. The organic light emitting display device of claim 3, wherein the second switch supplies the reference current to the at least one of the sample/hold sections that is not coupled with any of the current supply lines.

5. The organic light emitting display device of claim 4, wherein the at least one of the sample/hold sections is charged to a voltage corresponding to the reference current, and sinks the current corresponding to the charged voltage.

6. The organic light emitting display device of claim 5, wherein the reference current is equal to an electric current being supplied to the selected pixel when the selected pixel emits light with maximum luminance.

7. The organic light emitting display device of claim 1, wherein the address driver supplies an initialization signal partially overlapping the scan signal, and wherein the data driver supplies a data signal in synchronization with the initialization signal for initializing a voltage charged in the pixel.

8. The organic light emitting display device of claim 1, wherein the current sink receives the sinking current from the selected pixel when the selected pixel emits light with maximum luminance.

9. The organic light emitting display device of claim 8, wherein the selected pixel is charged with a voltage corresponding to the sinking current flowing into a current supply line coupled to the selected pixel.

10. The organic light emitting display device of claim 9, wherein the selected pixel receives the data signal and emits light according to the data signal responsive to the select signal being supplied to the selected pixel.

11. The organic light emitting display device of claim 10, wherein the data driver supplies a data signal of a first polarity to cause the selected pixel to not emit light and a data signal of a second polarity to cause the selected pixel to emit light.

12. The organic light emitting display device of claim 10, wherein the select signal is supplied at intervals of $2^0$, $2^1$, $2^2$, $2^3$ . . . units of time.

13. The organic light emitting display device of claim 1, wherein the address driver is in the scan driver.

14. An organic light emitting display device comprising:

a display region including a plurality of pixels coupled with scan lines, data lines, current supply lines, and address lines;

a scan driver for supplying a scan signal to the scan lines to sequentially drive the pixels in horizontal lines, a pixel selected by the scan signal being a selected pixel;

a current sink coupled with the current supply lines for sinking a sinking current from selected pixels;

an address driver for providing a select signal to the address lines at predetermined intervals of time; and a data driver for supplying a data signal to synchronize with the select signal, such that light emissions from the pixels are controlled by synchronization of the data signal and the select signal, wherein the current sink includes:

red sample/hold sections for sinking a first current from a current supply line coupled to a red pixel;

green scruple/hold sections for sinking a second current from a current supply line coupled to a green pixel;

blue sample/hold sections for sinking a third current from a current supply line coupled to a blue pixel;

a first switch for controlling coupling of the current supply lines to the red sample/hold sections, the green sample/hold sections, and the blue sample/hold sections;

a second switch for switching a red reference current to one of the red sample/hold sections, switching a green reference current to one of the green sample/hold sections, and switching a blue reference current to one of the blue sample/hold sections; and a controller for controlling the red sample/hold sections, the green sample/hold sections, the blue sample/hold sections, the first switch, and the second switch.

15. The organic light emitting display device of claim 14, wherein the number of the red sample/hold sections is one more than the number of the current supply lines coupled to the red pixel, wherein the number of the green sample/hold sections is one more than the number of current supply lines coupled to the green pixel, and wherein the number of the blue sample/hold sections is one more than the number of current supply lines coupled to the blue pixel.

16. The organic light emitting display device of claim 15, wherein the first switch connects all but one of the red sample/hold sections to the current supply line coupled with the red pixel, wherein the first switch connects all but one of the green sample/hold sections to the current supply line coupled with the green pixel, and wherein the first switch connects all but one of the blue sample/hold sections to the current supply line coupled with the blue pixel.

17. The organic light emitting display device of claim 16, wherein the second switch supplies the red reference current to the one red sample/hold section not being coupled with the current supply line, wherein the second switch supplies the green reference current to the one green sample/hold section not being coupled with the current supply line, and wherein the second switch supplies the blue reference current to the one blue sample/hold section not being coupled with the current supply line.

18. The organic light emitting display device of claim 17, wherein each pixel includes an organic light emitting diode, wherein the red reference current is equal to a current supplied to the organic light emitting diode of the red pixel for emitting light of maximum luminance, wherein the green reference current is equal to a current supplied to the organic light emitting diode of the green pixel for emitting light of maximum luminance, and wherein the blue reference current is equal to a current supplied to the organic light emitting diode of the blue pixel for emitting light of maximum luminance.

19. The organic light emitting display device of claim 14, wherein each of the pixels includes:

an organic light emitting diode;

first and second transistors coupled with a current supply line of the current supply lines and being turned-on by the scan signal;

a first capacitor chargeable with a voltage corresponding to an electric current flowing into the current supply line when the first and second transistors are turned-on;

a third transistor for supplying to the organic light emitting diode an electric current corresponding to a voltage charged in the first capacitor;

a fourth transistor coupled with a data line and being turned-on by the select signal;

a second capacitor chargeable with a voltage corresponding to an electric current flowing into the data line when the fourth transistor is turned-on; and a fifth transistor coupled between the third transistor and the organic light emitting diode, the fifth transistor being turned-on/off according to a voltage charged in the second capacitor.

20. The organic light emitting display device of claim 14, wherein the current sink receives the sinking current from the selected pixel when the selected pixel emits light with maximum luminance.

21. The organic light emitting display device of claim 20, wherein the selected pixel is charged with a voltage corresponding to the sinking current flowing into a current supply line coupled to the selected pixel.

22. The organic light emitting display device of claim 21, wherein the selected pixel receives the data signal and emits light according to the data signal responsive to the select signal being supplied to the selected pixel.

23. The organic light emitting display device of claim 22, wherein the data driver supplies a data signal of a first polarity to cause the selected pixel to not emit light and a data signal of a second polarity to cause the selected pixel to emit light.

24. The organic light emitting display device of claim 22, wherein the select signal is supplied at intervals of $2^0$, $2^1$, $2^2$, $2^3$ . . . units of time.

25. The organic light emitting display device of claim 14, wherein the address driver is in the scan driver.

* * * * *